US005086390A

United States Patent [19]

Matthews

[11] Patent Number: 5,086,390

[45] Date of Patent: Feb. 4, 1992

[54] SYSTEM FOR MONITORING PLAY OF A GOLFER

[76] Inventor: Gordon H. Matthews, 3700 Lost Creek Blvd., Austin, Tex. 78735

[21] Appl. No.: 464,917

[22] Filed: Jan. 16, 1990

[51] Int. Cl.[5] ..... G06F 15/28; G08B 23/00; A63B 67/02

[52] U.S. Cl. ..... 364/410; 340/323 R; 273/176 L

[58] Field of Search ..... 364/410, 411; 273/176 L, 176 AB, 176 R, 32 H, 32 R; 340/323 R, 993

[56] References Cited

U.S. PATENT DOCUMENTS

| | | | |
|---|---|---|---|
| 3,472,333 | 10/1968 | Loewenstern, Jr. | 180/89 |
| 3,662,267 | 5/1972 | Reed | 340/993 |
| 4,002,983 | 1/1977 | Kavalir et al. | 340/993 |
| 4,142,680 | 3/1979 | Oswald et al. | 340/993 |
| 4,303,243 | 12/1981 | Wolfe | 273/993 |
| 4,396,904 | 8/1983 | Hanaska | 340/323 R |
| 4,419,655 | 12/1983 | May | 273/176 L |
| 4,656,476 | 4/1987 | Tavtigian | 340/993 |
| 4,701,760 | 10/1987 | Raoux | 340/993 |
| 4,702,342 | 10/1987 | Hale | 180/333 |
| 4,857,886 | 8/1989 | Crews | 340/323 R |
| 4,926,161 | 5/1990 | Cupp | 340/572 |

FOREIGN PATENT DOCUMENTS

| | | | |
|---|---|---|---|
| 0095374 | 5/1983 | Japan | 273/85 G |
| 2207787 | 2/1989 | United Kingdom . | |

*Primary Examiner*—Dale M. Shaw
*Assistant Examiner*—Xuong M. Chung
*Attorney, Agent, or Firm*—Baker & Botts

[57] ABSTRACT

A system for monitoring the speed play of a golfer (24, 26) comprises Location Information Transmitters (LIT) (52, 54, 56) at predetermined locations within a golf course and a Mobile Electronic Transmitter/Receiver (METAR) (48, 50) carried in association with a golfer (24, 26) on a golf bag (30) or a golf cart (28). Each LIT (52, 54, 56) periodically transmits a LIT code over a restricted transmission range (58, 60, 62) such that when METAR (48) arrives within an LIT (54) transmission range (60), the METAR (48) receives the LIT code and subsequently initiates a counter to measure time required by the golfer (24) to move within transmission range (62) of a next LIT (56). If the counter exceeds a prescribed time, then a display on the METAR (48) indicates slow play.

Additonally, the METAR (48) transmits the received LIT code and a METAR code to a Tracking Center (22) display terminal. Golf course personnel can monitor the display terminal and determine play of golfers (24, 26), golf cart (28, 34) utilization and golf hole (10, 14) utilization. When the golfer (24) causes a slow play indication, the Tracking Center (22) is notified and the slow golfer (24) is asked to increase the rate of play or leave the golf course.

28 Claims, 7 Drawing Sheets

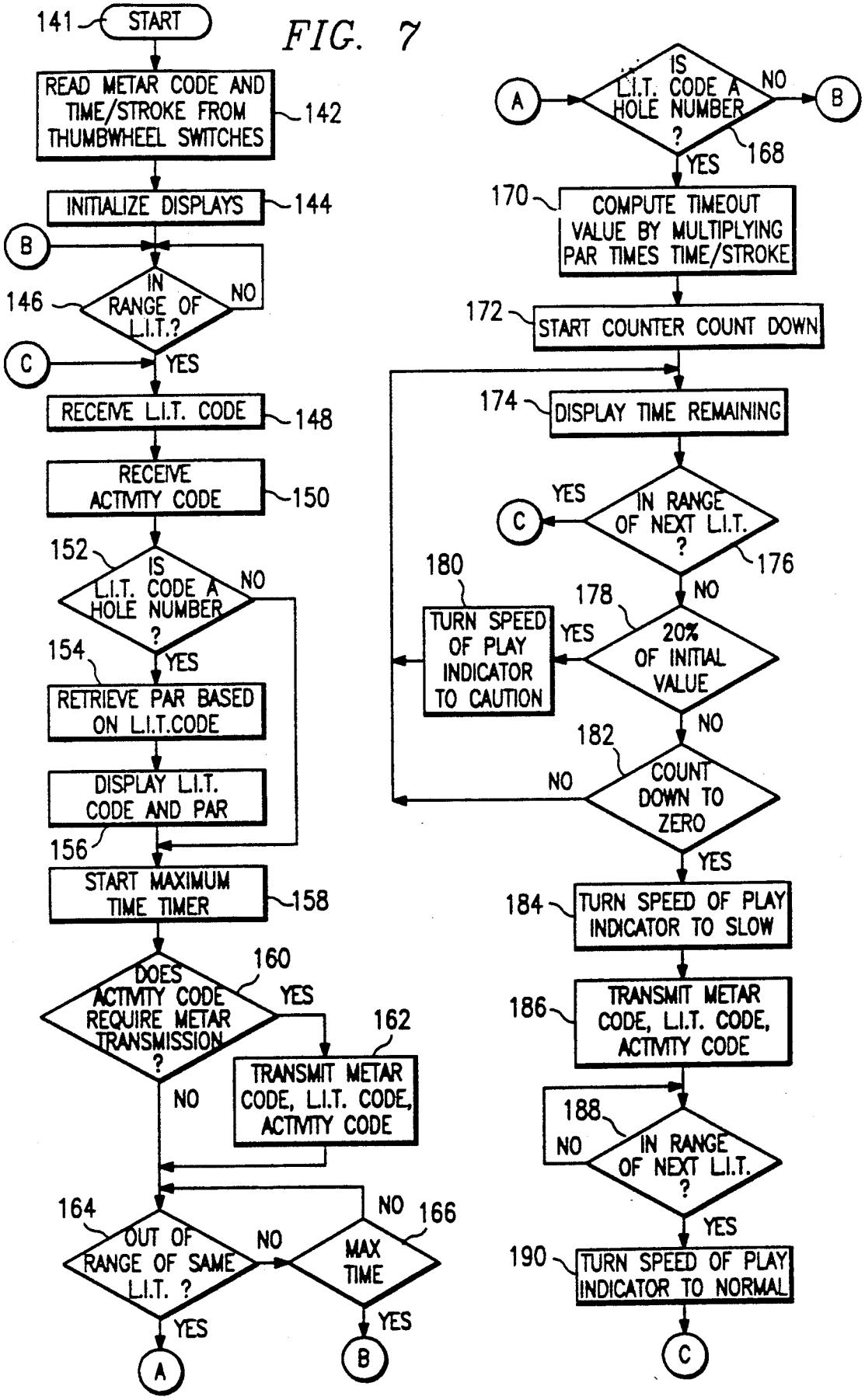
FIG. 7
141
START
READ METAR CODE AND TIME/STROKE FROM THUMBWHEEL SWITCHES
142
INITIALIZE DISPLAYS
144
B
146
IN RANGE OF L.I.T.?
NO
C
YES
RECEIVE L.I.T. CODE
148
RECEIVE ACTIVITY CODE
150
152
IS L.I.T. CODE A HOLE NUMBER ?
NO
154
YES
RETRIEVE PAR BASED ON L.I.T.CODE
DISPLAY L.I.T. CODE AND PAR
156
START MAXIMUM TIME TIMER
158
160
DOES ACTIVITY CODE REQUIRE METAR TRANSMISSION ?
YES
162
TRANSMIT METAR CODE, L.I.T. CODE, ACTIVITY CODE
NO
164
OUT OF RANGE OF SAME L.I.T. ?
NO
NO
166
MAX TIME
YES
YES
A
B
A
IS L.I.T. CODE A HOLE NUMBER ?
NO
B
YES
168
170
COMPUTE TIMEOUT VALUE BY MULTIPLYING PAR TIMES TIME/STROKE
172
START COUNTER COUNT DOWN
174
DISPLAY TIME REMAINING
YES
C
IN RANGE OF NEXT L.I.T. ?
176
NO
180
178
TURN SPEED OF PLAY INDICATOR TO CAUTION
YES
20% OF INITIAL VALUE
NO
182
NO
COUNT DOWN TO ZERO
YES
184
TURN SPEED OF PLAY INDICATOR TO SLOW
186
TRANSMIT METAR CODE, L.I.T. CODE, ACTIVITY CODE
188
NO
IN RANGE OF NEXT L.I.T. ?
YES
190
TURN SPEED OF PLAY INDICATOR TO NORMAL
C 278 280 282 284 286

| METAR NUMBER | SLOW PLAY HOLE | PAR | IDEAL TIME | ACTUAL TIME |
|---|---|---|---|---|
| 22 | 4 | 4 | 14:00 | 17:15 |
| 22 | 5 | 4 | 14:00 | 18:12 |
| 22 | 6 | 5 | 17:00 | 22:04 |
| 22 | 7 | 3 | 10:00 | 14:17 |

SYSTEM FOR MONITORING PLAY OF A GOLFER

TECHNICAL FIELD OF THE INVENTION

This invention pertains in general to systems for managing golf courses and more particularly to a system for monitoring play of a golfer and golf cart and golf hole utilization in a golf course.

BACKGROUND OF THE INVENTION

Golf is increasing in popularity to an extent that available golf courses are becoming crowded. It is thus important that golfers play at reasonable speeds to allow others to enjoy the golf course. Slow play by some players has thus become a significant problem, in that only a few slow players can delay many subsequent players.

The ideal round of golf requires approximately four hours to complete, but slow golfers often cause a round to take five or even six hours. Most golfers are thus upset by a five or six hour round of golf caused by excessive delays from slower players. Slow golfers disrupt the pace of other golfers, resulting in frustration and poorer scores. Many golfers refuse to play in crowded golf courses because slow play is more likely. Slow play reduces the number of golfers able to use a golf course, resulting in loss of revenue for the golf course.

Various attempts have been made to eliminate slow play. A golf course employee will sometimes personally observe golfers and detect slow play, but this method is expensive, inefficient, and disruptive. The employee can observe only one location at a time, and excessive employees may appear overbearing, as well as being expensive. Attempts to educate golfers regarding slow play have generally failed. Moreover, due to an inability to monitor the play of all players on a course, golf courses are often not able to efficiently utilize their courses, thus reducing the available income from the courses.

Therefore, a need has arisen for a system to automatically and unobtrusively monitor play of a golfer and to notify the golfer and golf course personnel of slow play.

SUMMARY OF THE INVENTION

The present invention disclosed and claimed herein describes a system and method for monitoring play of a golfer. It is a technical advantage of this invention that problems created by slow golfers are substantially eliminated. It is a further advantage of the present invention that information regarding the play of a golfer enables golf course personnel to study utilization of golf carts and golf holes within the golf course.

In one aspect of the invention, a golfer is notified of a slow play condition. It is a technical advantage of this aspect of the invention that a golfer is automatically warned when to take corrective action by increasing the speed of play.

In another aspect of the invention, golf course personnel are also notified of a slow play condition. It is a technical advantage of this aspect of the invention that golf course personnel are immediately alerted when to direct corrective action.

In still another aspect of the invention, information regarding play of a golfer is reported and stored for retrieval at a later time. It is a technical advantage of this aspect of the invention that slow play of a particular golfer can be documented and proved.

BRIEF DESCRIPTION OF THE DRAWINGS

For a more complete understanding of the present invention, and the advantages thereof, reference is now made to the following description taken in conjunction with the accompanying drawings, in which:

FIG. 7 illustrates a logic flow diagram of the METAR operation;

DETAILED DESCRIPTION OF THE INVENTION

Figure 1:
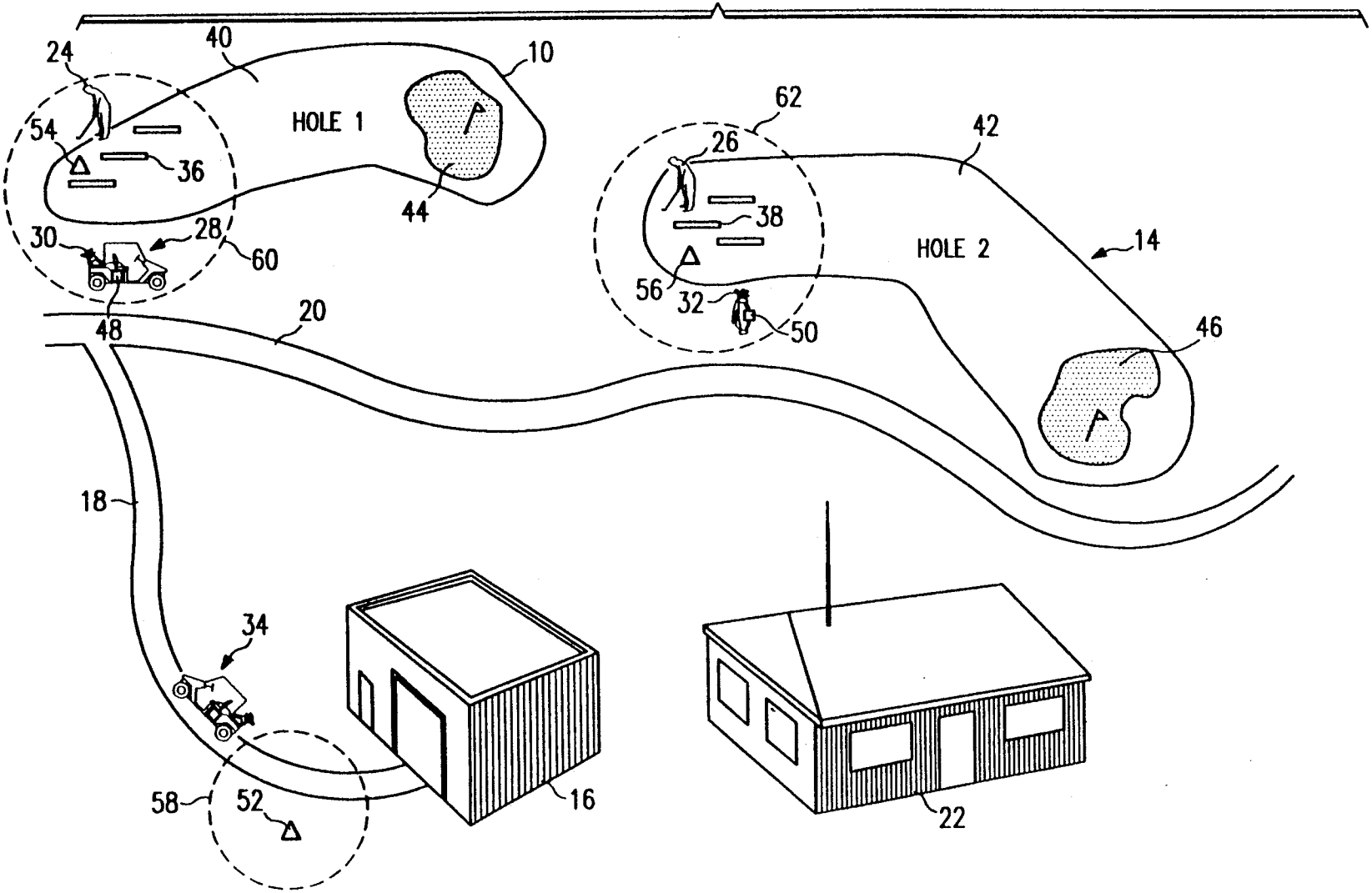
FIG. 1 illustrates a typical golf course equipped with the present invention.

The preferred embodiment of the present invention is best understood by referring to FIGS. 1—14 of the drawings, like numerals being used for like and corresponding parts of the drawing.

FIG. 1 illustrates a typical golf course equipped with the present invention. The golf course contains numerous golf holes such as those indicated generally at 10 and 14, a golf cart barn 16, golf cart pathways 18 and 20, and a clubhouse 22. Additional such holes included in the golf course are not shown in FIG. 1 but are of similar design as golf holes 10 and 14. Clubhouse 22 typically contains offices for golf course personnel, and a golf shop which sells equipment. Golfers 24 and 26 usually enter clubhouse 22 prior to playing a round of golf. Golf carts such as those indicated generally at 28 and 34 are stored and maintained in golf cart barn 16. These golf carts 28 and 34 travel throughout the golf course along golf cart pathways 18 and 20. Golfer 24 may rent golf cart 28 for transportation of golfer 24 and golf clubs 30. Alternatively, golfer 26 may choose to carry golf clubs 32 without aid of a golf cart.

Golf holes 10 and 14 include tee box areas 36 and 38, fairways 40 and 42, and greens 44 and 46. Golfers 24 and 26 sequentially proceed through the various golf holes 10 and 14 of the golf course, usually playing a total of eighteen golf holes. At a typical golf hole 10, golfer 24 begins play at tee box area 36 and proceeds to fairway 40, green 44 and ultimately to tee box area 38 of the next hole 14, where the play is continued in the same pattern.

In operation of the preferred embodiment shown in FIG. 1, golfers 24 and 26 each have a transmitter device, known as a Mobile Electronic Transmitter/-Receiver (METAR), 48 and 50 attached to either golf cart 28 or golf bag 32. Transmitters of a second type, known as Location Information Transmitters (LIT's), 52, 54 and 56 are placed at various locations throughout the golf course, including tee box areas 36 and 38 and golf cart pathways 18. Each LIT has a specified low power RF transmission range indicated by dotted line circles 58, 60 and 62.

Each LIT 54 periodically transmits a coded signal representing the location of LIT 54, such as a hole number. When golfer 24 with METAR 48 comes into range 60 of LIT 54, the circuitry of METAR 48 decodes the received signal and retrieves from its memory the length of time allotted for golfer 24 to play hole 10. A countdown timer in METAR 48 is then set to the allotted time and begun. When the timer reaches zero, indicating that golfer 24 has exceeded the allotted time for hole 10, METAR 48 notifies golfer 24 of the slow play. If golfer 24 completes hole 10 and crosses into range 62 of the next hole 14 before the count on the timer expires, the timer resets to the time allotted for hole 14 and the process continues for hole 14 and each subsequent hole.

In one embodiment, a transmitter in METAR 48 transmits a signal to golf shop 22 indicating the identity of METAR 48 and its location. In this manner, golf course personnel can monitor the location of each golfer and identify any slow players. If necessary, a golf course employee can immediately request the slow player to increase the speed of play. Furthermore, habitual slow play can be documented and the play later reprimanded or disciplined.

Figure 2:
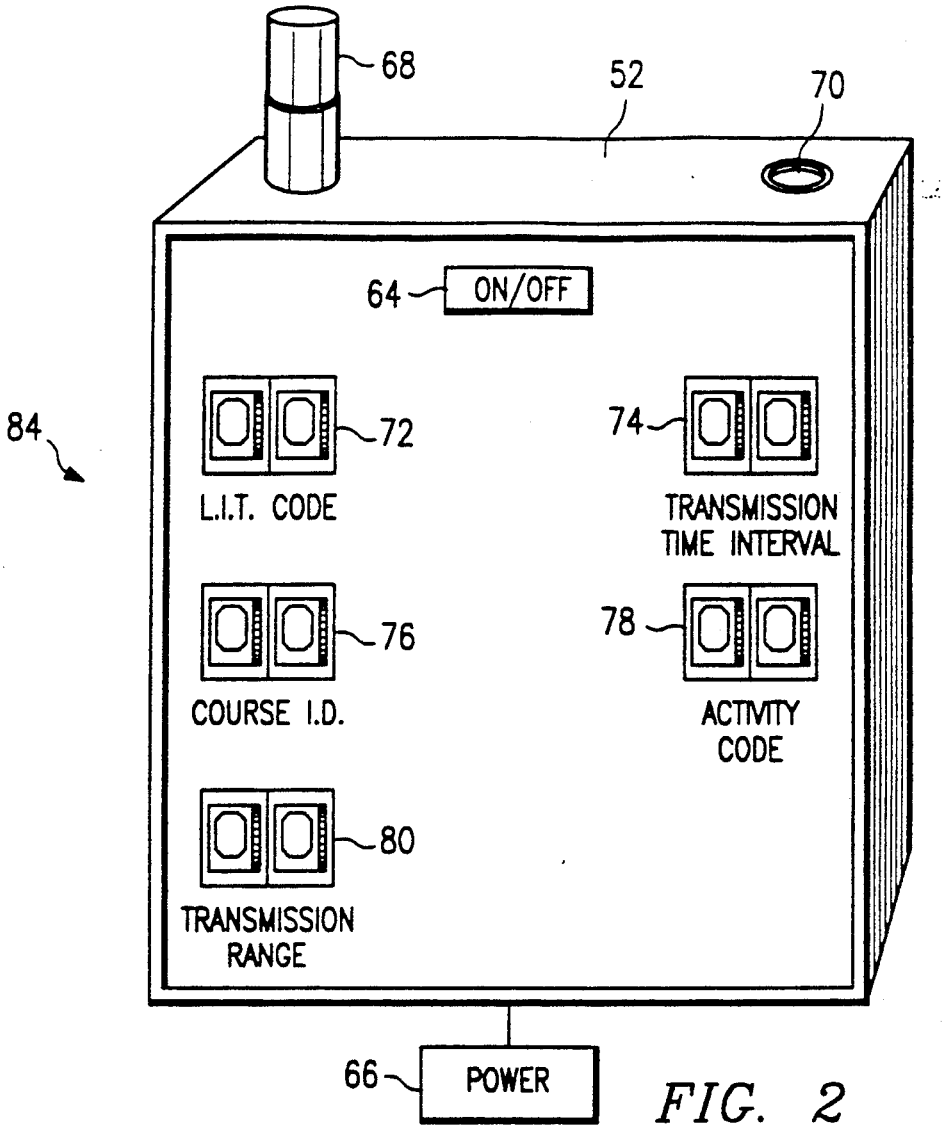
FIG. 2 illustrates a Location Information Transmitter (LIT) of the present invention.

FIG. 2 illustrates an LIT of the present invention such as LIT 52. LIT 52 contains an ON/OFF switch 64, power source 66, antenna 68 and light detector 70. Thumbwheel switches, indicated generally at 84, respectively allow selection of an LIT code 72, which is different for each LIT in the golf course, transmission time interval 74, course identification number 76, activity code 78 and transmission range 80. LIT 52 uses course identification number 76 to select its base transmission frequency, thus allowing simultaneous operation of the system at adjacent golf courses. Antenna 68 is used to transmit signals over a specified transmission range 58. LIT 52 transmits periodic signals with the time interval between signals determined by the setting of transmission time interval switch 74. Light detector 70 causes LIT 52 to shut off when it senses light levels which are insufficient for play, thus extending the useful life of power source 66. LIT 52 transmits both the LIT code and activity code set by switches 72 and 78, respectively.

Figure 3:
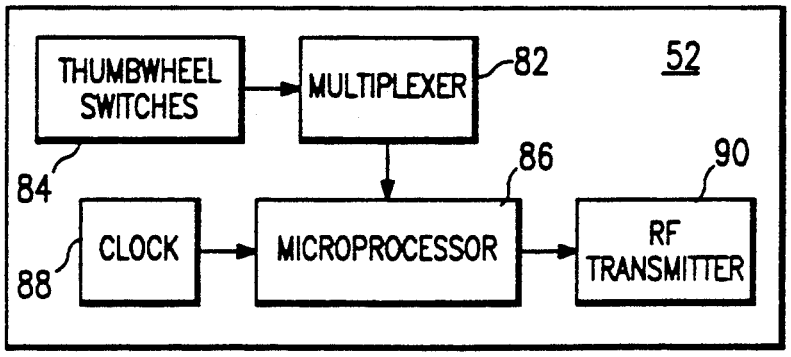
FIG. 3 illustrates a block diagram of the LIT.

FIG. 3 illustrates a block diagram of LIT 52. Multiplexer 82 converts positions of thumbwheel switches 84 into an input for microprocessor 86. Clock 88 controls the operation rate of microprocessor 86. At specified time intervals, microprocessor 86 sends data to an RF transmitter 90 for transmission of a signal.

Figure 4:
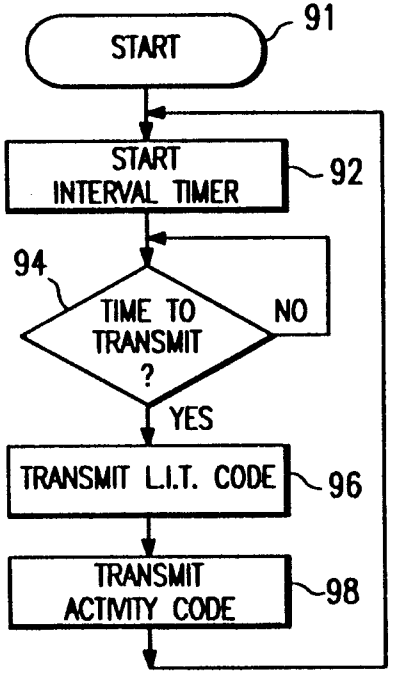
FIG. 4 illustrates a logic flow diagram of the LIT operation.

FIG. 4 illustrates a logic flow diagram of the operation of LIT 52. After power is applied in step 91, an interval timer, set by thumbwheel switch 74, is activated at step 92 to control the wait period between LIT transmissions. When the time expires in step 94, the LIT transmits its specified LIT code in step 96 and activity code in step 98. The interval timer is then restarted at step 92 and the cycle repeated.

Figure 5:
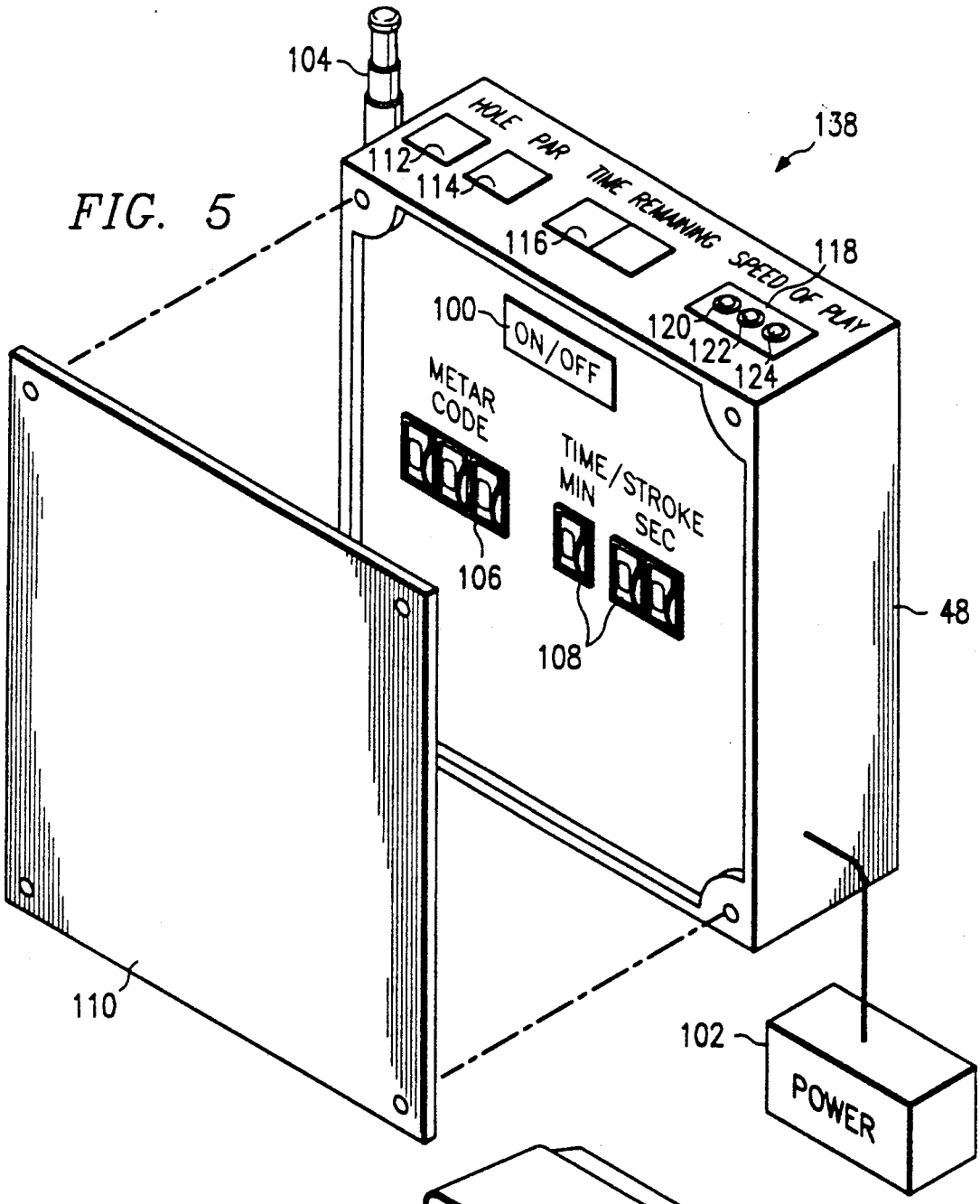
FIG. 5 illustrates a Mobile Electronic Transmitter/Receiver (METAR) of the present invention.

FIG. 5 illustrates a METAR of the present invention, such as METAR 48, having ON/OFF switch 100, power source 102 and antenna 104. Thumbwheel switches respectively allow selection of METAR code 106, which is different for each METAR in the golf course, and time per stroke 108. Golf course personnel attach protective cover 110 to prevent unauthorized modifications to thumbwheel switches 106 and 108. METAR 48 also contains displays, indicated generally at 138, which indicate golf hole number 112 currently being played, number of par strokes 114 allocated to the golf hole, time remaining 116 to play the current golf hole, and speed of play 118. Speed of play display 118 indicates SLOW 120 play, NORMAL 122 play, and CAUTION 124 which is activated when the speed of play narrowly falls within normal limits.

Figure 6:
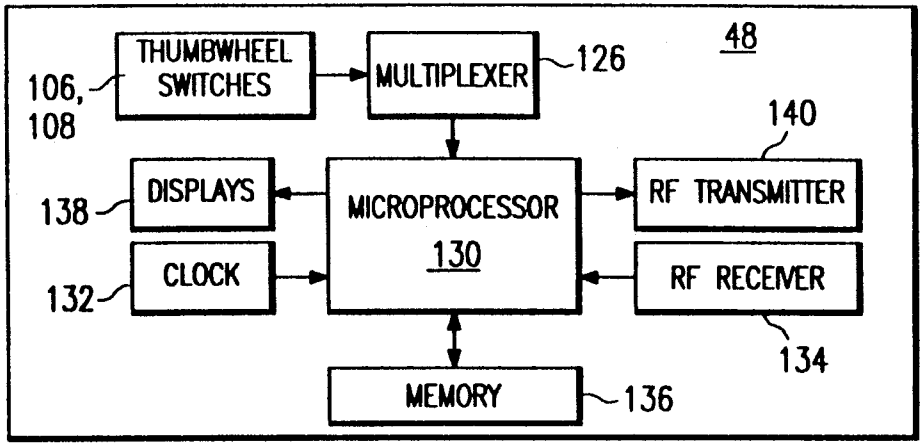
FIG. 6 illustrates a block diagram of the METAR.

FIG. 6 illustrates a block diagram of METAR 48. Multiplexer 126 converts positions of thumbwheel switches 106 and 108 into an input signal for microprocessor 130. Clock 132 controls the operation rate of microprocessor 130. RF receiver 134 receives signals transmitted from LIT 48 and sends this information to microprocessor 130. Based on the received information, METAR 48 retrieves data from its memory 136 and displays it on displays 138 and transmits it from an RF transmitter 140.

FIG. 7 illustrates a logic flow diagram of METAR 48 operation. After METAR 48 is initially activated in step 141, microprocessor 130 reads thumbwheel switches 106 and 108 in step 142 to determine a time per stroke value and a METAR code, the displays 138 are initialized in step 144. A decision is made in decision block 146 whether METAR 48 has arrived within transmission range 60 of LIT 54. Once METAR 48 arrives within transmission range 60 of LIT 54, it receives the LIT code from LIT 54 in step 148 and activity code in step 150.

A determination is made in decision block 152 as to whether the LIT code received corresponds to an actual golf hole. If so, METAR 58 retrieves in step 154 from its memory 136 the number of par strokes corresponding to the golf hole. METAR 58 displays par value and LIT code in step 156 and then starts a maximum time timer in step 158.

If it is determined in decision block 152 that the LIT code does not correspond to an actual golf hole, the microprocessor instructions jump directly to step 158 where the maximum time timer is started.

After initiating the maximum time timer in step 158, METAR 52 determines in decision block 160 whether the activity code requires that the METAR immediately transmits information. If so, transmitter 140 transmits the METAR code, the received activity code and the received LIT code in step 162.

Decision blocks 164 and 166 determine, respectively, whether METAR 52 has left LIT transmission range 60 and, if not, whether the maximum time timer has expired. If METAR 52 leaves range 60 before the timer expires, execution of instructions continues with decision block 168. If the timer expires before METAR 52 is out of range 60, then execution returns to decision block 146.

After passing control to decision block 168, METAR 52 determines if the LIT code corresponds to an actual golf hole. If not, then operation returns to decision block 146. If the LIT code does correspond to an actual golf hole, METAR 52 computes a counter time-out value in step 170 by multiplying the stored par value with the specified time per stroke value. The time-out value immediately begins decrementing in step 172, and METAR 52 displays the remaining time on display 138 in step 174.

If the next LIT 56 is encountered before expiration of the remaining time displayed on display 138, as determined in decision block 176, then operation returns to decision block 148. Otherwise, in decision block 178, if the counter reaches 20% of its initial time-out value, METAR 52 in step 180 indicates CAUTION on speed of play display 124 and operation continues with decision block 176. If the count expires in decision block 182, METAR 52 in step 184 indicates SLOW on speed of play display 120, and transmitter 140 transmits its METAR code, the activity code and the LIT code in step 186. When METAR 52 detects a next LIT in decision block 188, METAR 52 in step 190 indicates NORMAL on speed of play display 122, and operation returns to block 148.

Figure 8:
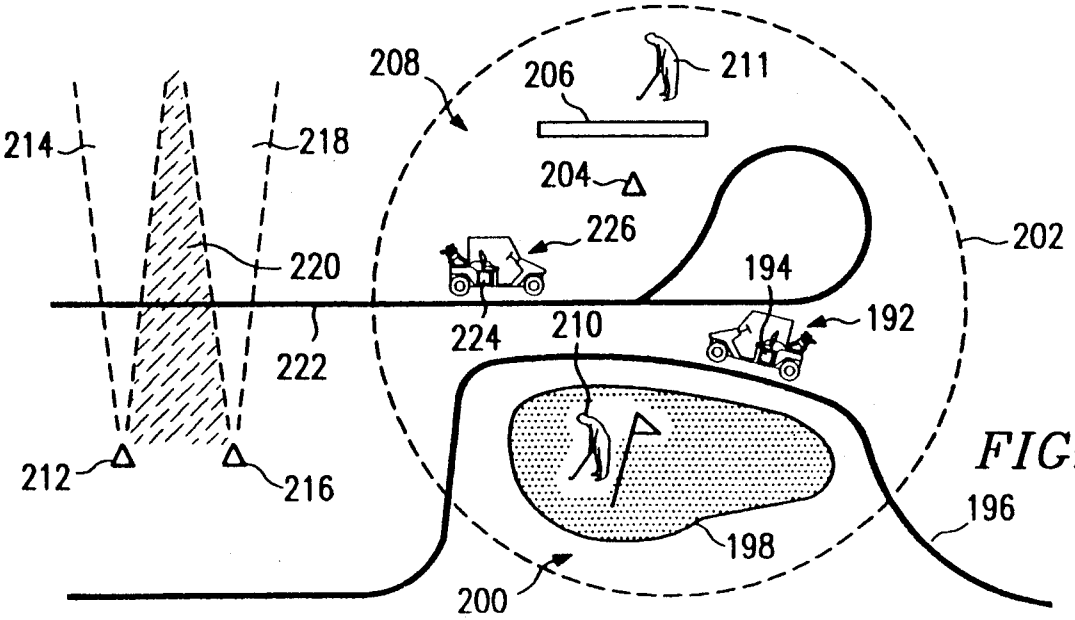
FIG. 8 illustrates the use of two LIT's at a single golf course location.

FIG. 8 illustrates an embodiment of the present invention using two LIT's at a single golf tee box area. As the golf cart, indicated generally at 192 and containing METAR 194, travels along golf cart path 196 associated with green area 198 of a golf hole, indicated generally at 200, METAR 194 enters transmission range 202 of LIT 204 located at tee box area 206 of adjacent golf hole, indicated generally at 208, even though golfer 210 assigned to METAR 194 is not utilizing adjacent golf hole 208. This condition results in a false indication of activity by golfer 210 at adjacent golf hole 208.

The false indication of golfer 210 activity is corrected by replacing LIT 204 of adjacent golf hole 208 with first LIT 212 having first transmission range 214 and second LIT 216 having second transmission range 218. Two transmission ranges 214 and 216 define border 220 across appropriate golf cart path 222 associated with adjacent golf hole 208. METAR 224 on the golf cart indicated generally at 226 is programmed to trigger upon passage of METAR 224 from second LIT 216 to first LIT 212. It can also be programmed to trigger upon passage from first LIT 212 to second LIT 216. In this manner, METAR 224 detects activity by golfer 211 at adjacent golf hole 208 only when golf cart 226 travels along golf cart path 222 associated with adjacent golf hole 208 and not when golf cart 192 travels along golf cart path 196.

Figure 9:
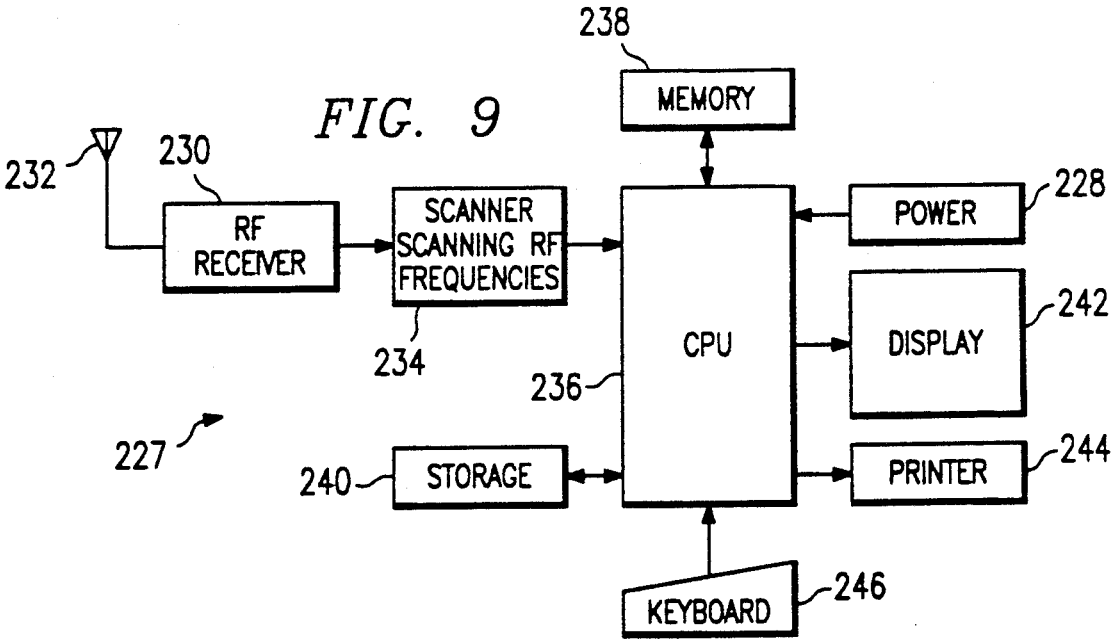
FIG. 9 illustrates a block diagram of a Tracking Center of the present invention.

FIG. 9 illustrates a block diagram of a Tracking Center indicated generally at 227, normally located in clubhouse 22 of a golf course equipped with the present invention. Tracking Center 227 has power source 228. RF receiver 230 receives radio signals from antenna 232 and outputs these signals to scanner 234 monitoring various RF frequencies for METAR transmissions. When a METAR transmission is detected, the scanner outputs the received data to CPU 236. CPU 236 stores and retrieves data in memory 238 and storage device 240. CPU 236 also outputs data to display terminal 242 and printer 244. Keyboard 246 permits golf course personnel to enter instructions to the 236. In the preferred embodiment, CPU 236, memory 238 and storage 240 are contained in a personal computer (PC).

Figure 10:
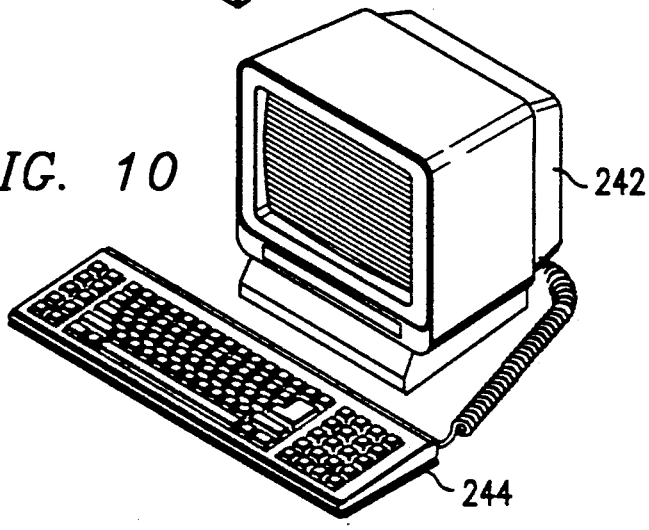
FIG. 10 illustrates a display terminal of the Tracking Center.

FIG. 10 illustrates Tracking Center's 227 display terminal 242 and keyboard 246.

Figures 11, 14:
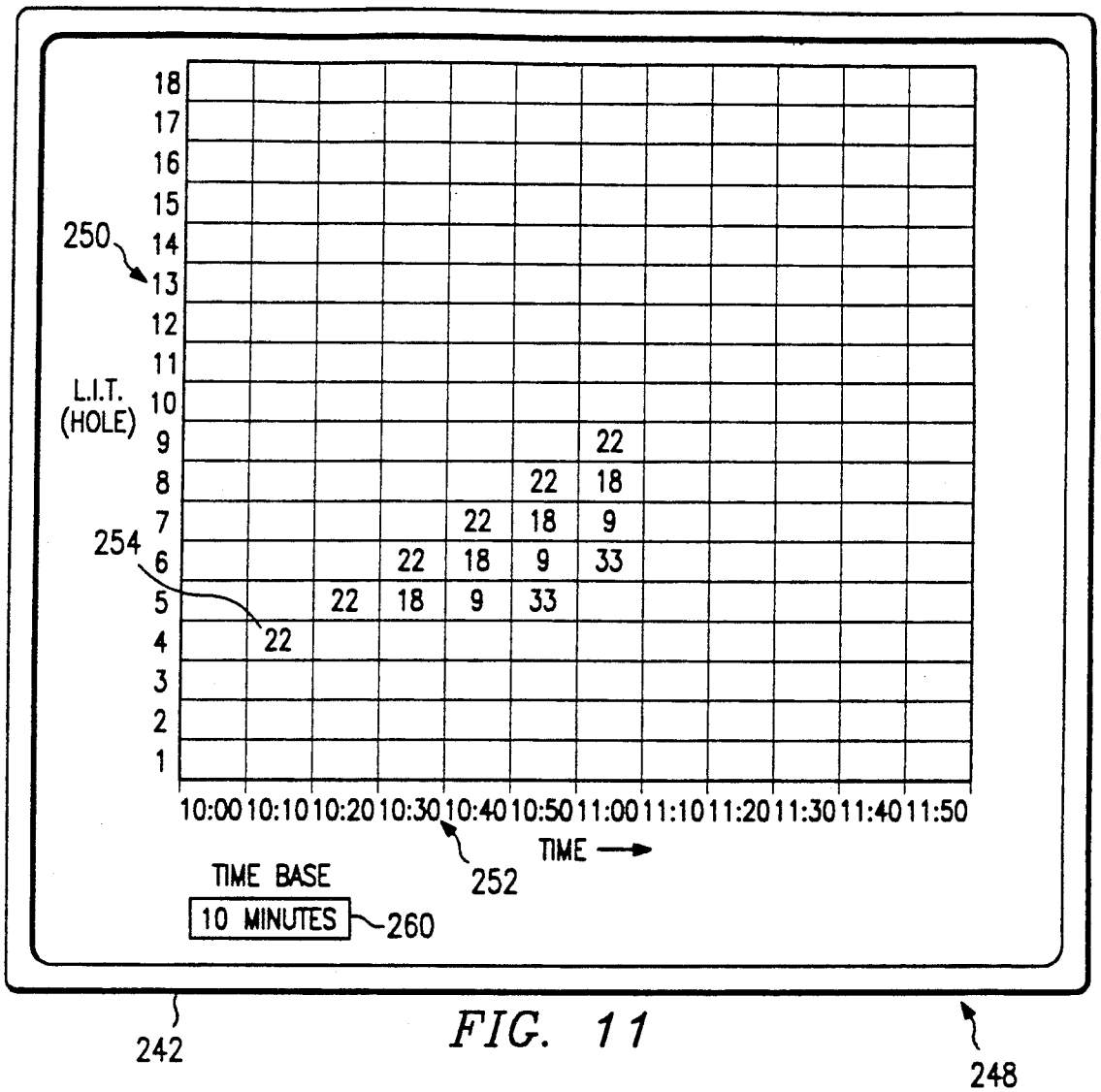
FIG. 11 illustrates a data chart on the display terminal.
FIG. 14 illustrates a report from the tracking center.

FIG. 11 illustrates a data chart indicated generally at 248 displayed on display terminal 242. Data chart 248 indicates golf cart utilization, golf hole utilization and golfer activity at the golf course by displaying LIT numbers along one axis, indicated generally at 250, and time along the other axis, indicated generally at 252. The position of METAR code 254 on data chart 248 is a function of time 252 and location 250 of the corresponding METAR. Time base 260 is specified by golf course personnel to establish the interval between displayed times 252.

Figure 12:
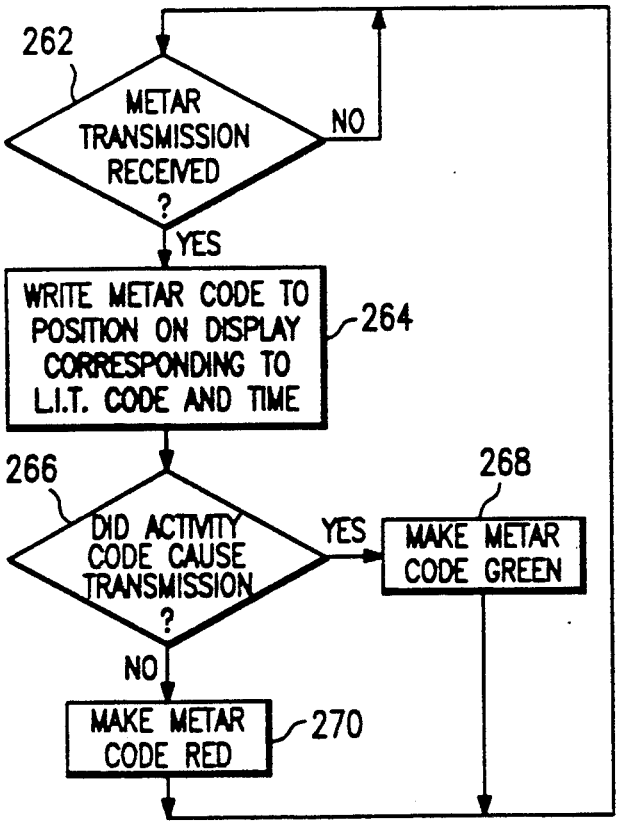
FIGS. 12 and 13 illustrate logic flow diagrams of the display terminal operation.
Figure 13:
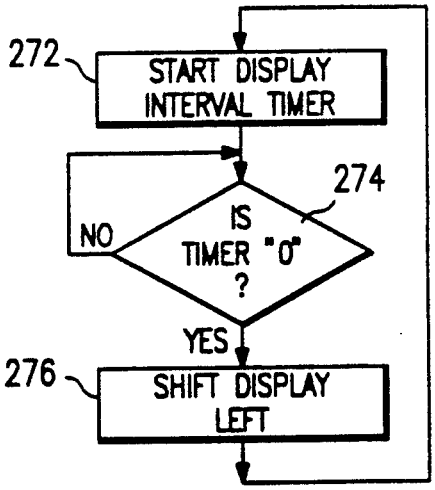

FIGS. 12 and 13 illustrate logic flow diagrams of the display terminal operation. Beginning at decision block 262 in FIG. 12, when RF receiver 230 at the Tracking Center 227 receives a METAR transmission, CPU 236 writes the received METAR code in step 264 to the data chart at an appropriate position consistent with the received LIT code and the current time. If the METAR transmission was caused by an activity code, determined at decision block 266, METAR code 254 will be displayed in the color green, step 268. If the METAR transmission .vas not caused by an activity code, the METAR code will be displayed in the color red, step 270. Execution then returns to decision block 262 in which the Tracking Center 227 waits for another transmission.

In FIG. 13, Tracking Center 227 in step 272 activates an interval timer to determine in decision block 274 when it must shift data chart 248 left. Each time the interval set in step 272 expires, all METAR codes and time labels displayed on display terminal 242 are shifted left in step 276, resulting in deletion of the extreme left METAR codes and time label, and insertion of a new time label at the extreme right end of data chart 248.

Data chart 248 dynamically indicates the status and location of golf carts and golfers throughout the golf course. In FIG. 11, for example, the golfer utilizing METAR #22 has created a slow play condition during the time interval from 10:10 to 10:19 on hole number 4. This same golfer also played slowly between 10:20 and 10:29 on hole number 5, thus causing a second golfer utilizing METAR #18 to slow play at hole number 5 between 10:30 and 10:39. The initial slow play condition ultimately compounded itself by causing golfers using METARs #9 and #33 to also slow play.

All information displayed on the data chart is stored by Tracking Center 227 for retrieval at a later time. This feature enables golf course personnel to document and prove slow play of a particular golfer and to study the utilization of golf carts and golf holes within the golf course.

FIG. 14 illustrates a report of slow play data. Each row of the report contains METAR number 278, the golf hole where slow play occurred 280, the par value assigned to particular golf hole 282, the ideal time for playing golf hole 284, and the actual playing time taken of golfer 286.

In one embodiment of the invention, the LIT does not transmit variable encoded information but instead merely transmits a non-encoded low power RF signal. This embodiment decreases the complexity and cost of each LIT. The METAR can determine its location within the golf course by counting the number of sequential LIT's it encounters. For example, if one LIT is located at the golf cart barn and one LIT is located at each golf hole throughout the golf course, then a METAR attached to a golf cart can determine its location at the seventh golf hole after eight sequential LIT's are encountered, including one LIT at the golf cart barn, six LIT's at the preceding six golf holes, and one LIT at the seventh golf hole itself. In this embodiment, however, the chance for errors is increased because RF signal fluctuations at the edges of a LIT transmission range can cause the METAR to count a single LIT more than once. This problem is addressed by designing the METAR to wait a specified time before incrementing its counter.

In another embodiment of the invention, the counter time-out operation to determine slow play is performed on an LIT rather than the METAR. When a METAR arrives within range of a first LIT, the METAR transmits its METAR code and time per stroke value to the LIT which initiates the counter operation. When the METAR subsequently arrives within range of a second LIT, the METAR again transmits its METAR code and time per stroke value. The first LIT receives this information and stops its counter. If the first LIT does not receive the second transmission from the METAR before expiration of the LIT counter, then the first LIT transmits its LIT code, activity code and the METAR code to a Tracking Center. The transmission from the first LIT is also received by the METAR which indicates SLOW on its speed of play display.

A variation of the second embodiment may be implemented wherein the second transmission by the METAR is received solely by the second LIT, which then directs the first LIT to stop its counter. Alternatively, the counter operation can be performed on the second LIT after the first LIT directs the second LIT to begin the counter operation. When the METAR later arrives within range of the second LIT, the second LIT stops its counter. If the counter expires before the METAR arrives, then the second LIT transmits a message to the Tracking Center indicating slow play.

By performing the counter operation on an LIT rather than a METAR, the required transmission range of the METAR is greatly reduced because the METAR communicates solely with LIT's located proximate to the METAR. Consequently, the METAR power consumption is also reduced, resulting in a smaller power supply and increased mobility of the METAR unit. Mobility of the METAR unit is especially important when the METAR is attached to a golf bag without transportation aid of a golf cart.

In still another embodiment, the counter operation is performed at the Tracking Center. When the METAR arrives within range of an LIT, the LIT transmits information to the Tracking Center including METAR code, time per stroke value, LIT code and activity code. The Tracking Center then initiates the counter operation. If the Tracking Center does not receive a second transmission containing the same METAR code before the counter expires, then the Tracking Center transmits a message to a receiver associated with the METAR signalling the slow play condition. This alternative embodiment provides the advantage of decreased METAR power consumption because a METAR communicates solely with LIT's located proximate to the METAR. Furthermore, LIT's are not required to communicate with each other because LIT's do not perform the counter time-out operation.

In another embodiment, the METAR continually transmits low power signals. When an LIT receives a METAR transmission, the LIT transmits its own LIT code and activity code in the METAR. This embodiment reduces LIT power consumption but increases power consumed by the METAR.

In further embodiments, the Tracking Center sends messages to golfers to an alphanumeric display associated with the METAR. Likewise, golf players use a METAR keyboard to send messages to the Tracking Center, such as scores and requests for assistance.

It is also possible in the present invention to store activity codes on the METAR and time per stroke values on the LIT. Furthermore, an LIT can be located on a green or fairway, in addition to tee box areas. The counter operation can be initiated when the METAR arrives at an LIT, rather than the preferred embodiment's manner of waiting until the METAR leaves a LIT transmission range.

Although a preferred embodiment of the present invention has been described in detail, this embodiment is subject to various changes, substitutions and alterations which can be made without departing from the spirit and scope of the invention as defined by the appended claims.

What is claimed is:

1. A system for monitoring a golfer's play within a golf course, comprising:

a plurality of location transmitters each proximate to a corresponding golf hole within said golf course and each operable to transmit a corresponding location signal associated therewith;

a mobile receiver carried in association with said golfer for receiving said corresponding location signals each responsive to said golfer being proximate to said golf hole corresponding to said location signal;

means for determining a length of time for said golfer to play one of said corresponding golf holes based upon first and second ones of said corresponding location signals received by said mobile receiver, said first location signals indicating when said golfer is proximate to each said golf hole associated therewith, and said second location signals indicating when said golfer ceases being proximate to each said golf hole associated therewith; and means for comparing a predetermined time against said length of time for said golfer to play in order to enable the determination of whether the golfer played the golf hole within the predetermined time.

2. The system of claim 1 wherein said determining means begins determining said length of time in response to at least one said second location signal.

3. The system of claim 1 wherein said mobile receiver is further operable to receive a reference signal from a predetermined location within said golf course and further comprising means coupled to said mobile receiver for determining whether said golfer is playing one of said corresponding golf holes, based upon whether said mobile receiver receives one of said corresponding location signals prior to receiving said reference signal.

4. The system of claim 1 and further comprising means responsive to said determining means for indicating a slow play occurrence responsive to said golfer failing to play said golf hole within the predetermined time.

5. The system of claim 1 and further comprising a mobile transmitter carried in association with said golfer, responsive to said determining means for transmitting a play monitoring signal responsive to said golfer failing to play said golf hole within the predetermined time.

6. The system of claim 5 and further comprising means for displaying which of said corresponding golf holes said golfer failed to play within the predetermined time, based upon said play monitoring signal.

7. The system of claim 5 and further comprising a monitoring receiver operable to receive said play monitoring signals.

8. The system of claim 5 wherein said mobile transmitter transmits said play monitoring signal in response to a command from said golfer.

9. The system of claim 1 wherein said mobile receiver carried in association with said golfer is carried by a golf cart of said golfer.

10. The system of claim 1 wherein said mobile receiver carried in association with said golfer is carried by a golf bag of said golfer.

11. The system of claim 1 wherein said mobile receiver carried in association with said golfer is carried by said golfer.

12. The system of claim 1 wherein said location transmitters are each further operable to stop transmission of said corresponding location signal when a light condition is insufficient for playing golf.

13. A system for monitoring a golfer's play within a golf course, comprising:

a plurality of location transmitters each proximate to a corresponding golf hole within said golf course and each operable to transmit a corresponding location signal associated therewith;

a mobile receiver carried in association with said golfer for receiving said corresponding location signals each responsive to said golfer being proximate to said golf hole corresponding to said location signal;

a mobile transmitter carried in association with said golfer, operable to transmit a plurality of play monitoring signals each responsive to a received corresponding location signal, first ones of said play monitoring signals indicating when said golfer is proximate to each said golf hole corresponding to said received location signal, and second ones of said play monitoring signals indicating when said golfer ceases being proximate to each said golf hole corresponding to said received location signal;

means for determining a length of time for said golfer to play one of said corresponding golf holes based upon said first and second play monitoring signals; and means for comparing a predetermined time against said length of time for said golfer to play in order to enable the determination of whether the golfer played the golf hole within the predetermined time.

14. The system of claim 13 wherein said determining means begins determining said length of time in response to at least one said second play monitoring signal.

15. The system of claim 13 and further comprising means responsive to said determining means for indicating a slow play occurrence responsive to said golfer failing to play said golf hole within the predetermined time.

16. The system of claim 13 wherein said mobile transmitter carried in association with said golfer is carried by a golf cart of said golfer and further comprising means for monitoring a time when said golf cart is utilized within said golf course, based upon said first and second play monitoring signals.

17. A method for monitoring a golfer's play within a golf course, comprising the steps of:

transmitting a corresponding location signal from each of a plurality of location transmitters each proximate to a corresponding golf hole within said golf course associated therewith;

receiving said corresponding location signals with a mobile receiver carried in association with said golfer, each in response to said golfer being proximate to said golf hole corresponding to said location signal; and determining a length of time for said golfer to play one of said corresponding golf holes based upon first and second ones of said corresponding location signals received by said mobile receiver, said first location signals indicating when said golfer is proximate to each said golf hole associated therewith, and said second location signals indicating when said golfer ceases being proximate to each said golf hole associated therewith; and comparing a predetermined time against said length of time for said golfer to play in order to enable the determination of whether the golfer played the golf hole within the predetermined time.

18. The method of claim 17 wherein said step of determining comprises the step of determining a length of time for said golfer to play one of said corresponding golf holes in response to at least one said second location signal.

19. The method of claim 17 and further comprising the steps of:

receiving a reference signal with said mobile receiver from a predetermined location with said golf course; and determining whether said golfer is playing one of said corresponding golf holes, based upon whether said mobile receiver receives one of said corresponding location signals prior to receiving said reference signal.

20. The method of claim 17 and further comprising the step of indicating a slow play occurrence in response to said golfer failing to play said golf hole within the predetermined time.

21. The method of claim 17 and further comprising the step of transmitting a play monitoring signal from a mobile transmitter carried in association with said golfer, in response to said golfer failing to play said golf hole within the predetermined time.

22. The method of claim 21 and further comprising the step of displaying which of said corresponding golf holes said golfer failed to play within the predetermined time, based upon said play monitoring signal.

23. The method of claim 21 wherein said step of transmitting said play monitoring signal comprises the step of transmitting said play monitoring signal in response to a command from said golfer.

24. The method of claim 17 and further comprising the step of stopping said transmitting of said corresponding location signals when a light condition is insufficient for playing golf.

25. A method for monitoring a golfer's play within a golf course, comprising the steps of:

transmitting a corresponding location signal from each of plurality of location transmitters each proximate to a corresponding golf hole within said golf course associated therewith;

receiving said corresponding location signals with a mobile receiver carried in association with said golfer, each in response to said golfer being proximate to said golf hole corresponding to said location signal;

transmitting a plurality of play monitoring signals from a mobile transmitter carried in association with said golfer, each in response to a received corresponding location signal, first ones of said play monitoring signals indicating when said golfer is proximate to each said golf hole corresponding to said received location signal, and second ones of said play monitoring signals indicating when said golfer ceases being proximate to each said golf hole corresponding to said received location signal;

determining a length of time for said golfer to play one of said corresponding golf holes based upon said first and second play monitoring signals; and comparing a predetermined time against said length to time for said golfer to play in order to enable the determination of whether the golfer played the golf hole within the predetermined time.

26. The method of claim 25 wherein said step of determining comprises the step of determining a length of time for said golfer to play one of said corresponding golf holes in response to at least one said second play monitoring signal.

27. The method of claim 25 and further comprising the step of indicating a slow play occurrence in response to said golfer failing to play said golf hole within the predetermined time.

28. The method of claim 25 and further comprising the step of monitoring a time when a golf cart of said golfer is utilized within said golf course, based upon said first and second play monitoring signals, wherein sid mobile receiver carried in association with said golfer is carried by said golf cart.

* * * * *